United States Patent [19]

Taragna et al.

[11] Patent Number: 4,605,137

[45] Date of Patent: Aug. 12, 1986

[54] BOTTLE CAP

[75] Inventors: Luigi Taragna, Rome; Antonio Giovannelli, Anzio, both of Italy

[73] Assignee: Italcaps S.p.A., Aprilia, Italy

[21] Appl. No.: 719,471

[22] Filed: Apr. 3, 1985

[30] Foreign Application Priority Data

Apr. 12, 1984 [IT] Italy ..... 48025 A/84

[51] Int. Cl.[4] ..... B65D 41/42

[52] U.S. Cl. ..... 215/254

[58] Field of Search ..... 215/254

[56] References Cited

U.S. PATENT DOCUMENTS

| | | | |
|---|---|---|---|
| 3,963,140 | 6/1976 | Harding | 215/254 |
| 3,974,931 | 8/1976 | Moller | 215/254 |
| 4,003,488 | 1/1977 | Moller | 215/254 |

*Primary Examiner*—Donald F. Norton

*Attorney, Agent, or Firm*—Cushman, Darby & Cushman

[57] ABSTRACT

A bottle cap of the tear-off type, particularly an easy-to-open cap for wide mouth bottles, in which a central top wall which covers the top portion of the mouth of the bottle is connected to a lateral band which surrounds the opening of the neck of the bottle and is bent under the edge of the neck to grip the cap, while a tear-off tab, bounded by one or more score lines, extends from the top wall through the lateral band and an angular sealing gasket is interposed between the mouth of the bottle and the top wall and the lateral band, respectively. The angular sealing gasket is bonded to the undersurface of the central top wall at a bond area inside the score line or lines, whereby, when the cap is broken by lifting the central top wall by means of the tear tab, the angular sealing gasket is lifted with it in one piece and slips off from underneath the lateral band, ousting it.

The sealing gasket can also be bonded to the tear tab at the area bounded by the score line or lines towards the lateral band, to make the lifting of the sealing gasket itself along with the central top wall easier, without breaking it.

5 Claims, 3 Drawing Figures

BOTTLE CAP

DESCRIPTION

The present invention refers to a bottle cap and more particularly to an easy-to-open tear-off cap for use with bottles having a neck with a mouth of relatively wide diameter.

A number of types of tear-off caps of this kind are known, having a top wall connected to a lateral band or skirt, which surrounds the opening of the neck of the bottle and is bent under the edge of the neck to grip the cap. As a sealing element between the bottle and cap, a sealing ring or sealant is provided, located between the cap itself, generally metallic and made from an aluminium alloy, and the edge of the mouth of the bottle.

For the opening of such caps a tear-off tab is provided, carried out as an extension, towards the outside of an area of the lateral band, whereas one or more score lines, generally two, are carried out in various ways both on the lateral band and on the top wall in order to make the opening operation easier.

In fact, the main drawback of prior art caps consisted of difficulty in opening, particularly in the case of wide mouth bottles, since the opening involves breaking the metal and generally the sealing by means of a tearing action. This action is carried out by the user with noticeable strains applied to the tear tab with one hand, while with the other hand he holds the bottle and opposes the reactions due to such strains.

Since the strains and the reactions are noticeable, particularly due to the grip effect of the lateral band of the cap on the edge of the mouth of the bottle in the case of the wide mouth bottles, the risk of the liquid leaking out, and also of the bottle overturning, is great.

This grip effect is generally further enhanced by the presence of the sealing ring or sealant, generally angular in cross-section, which is part of the cap itself. The sealing ring or sealant adheres generally along all its surface of contact with the metal, in order to avoid both separation during handling of the cap until closure of the bottle, and avoid possible escape paths of carbonation of the enclosed drinks, and forms a seal gasket compressed between the glass and the metal upon the gripping of the cap.

Furthermore, this seal gasket has the drawback of easily getting stuck to the mouth of the bottle, especially when the bottled product contains a percentage of sugar, which, by solidifying, acts as a glue.

Therefore, due to the effect of the bonding action of the seal gasket, but especially due to the residual grip; that is the grip that the cap portion, generally C shaped, which is still in contact with the mouth of the bottle exercises on the edge of the mouth itself due to the gripping action provided on the cap upon its application to the bottle; the tearing force needed to ensure the separation of the cap from the bottle can become very high, as far as in the range of some kilograms.

In order to try to eliminate or at least to partially reduce this drawback, a number of attempts have been carried out.

For instance, in the U.S. Pat. No. 2,068,444 it was suggested to reduce the residual gripping effect by making use of circular score lines more or less concentric with the mouth of the bottle and located towards the periphery of the top wall of the cap.

Elsewhere it has been tried to act on the form or on the breaking way of the sealing, but in all solutions until now available, the residual gripping effect and the bonding of the sealing is not obviated, or where this drawback is reasonably solved, the proposed embodiment does not allow the necessary tightness of the highest pressures required in the case of bottling highly carbonated drinks or drinks to be subjected to the operation of pasteurization.

Therefore, the main object of the present invention is to provide a bottle cap, particularly for wide mouth bottles, having an easy-to-open feature which avoids the leaking out of the liquid on opening the bottle.

A further object is to carry out such a cap in a simple and cheap way, suitable for mass production.

The cap according to the present invention is characterized in that the angular sealing gasket is bonded to the undersurface of the central top wall at a bond area inside the score line or lines, whereby, when the cap is broken by lifting the central top wall by means of the tear tab, the angular sealing is lifted with it in one piece and slips off from underneath the lateral band, ousting it.

The angular sealing can further be bonded to the tear tab in the area bounded by the score line or lines towards the lateral band, to make the lifting of the sealing gasket itself along with the central top wall easier, without breaking it.

Therefore, with the present cap, one achieves the advantage that the opening is made easier by the fact that, on one hand, it is no longer necessary to break the sealing to cause the release of the grip action of the lateral band on the edge of the bottle, whereas, on the other hand, the fact that the sealing is slipped off from underneath the lateral band causes a "tin-opener" effect which moves apart the opened hems of the lateral band, all this without being detrimental to the internal pressure tightness at the highest usual limits.

In the following, the present invention will be further clarified from the description of one form of a practical embodiment of the bottle cap, the description being made in a purely illustrative and not limiting way, with reference to the accompanying drawing, in which.

Figure 1:
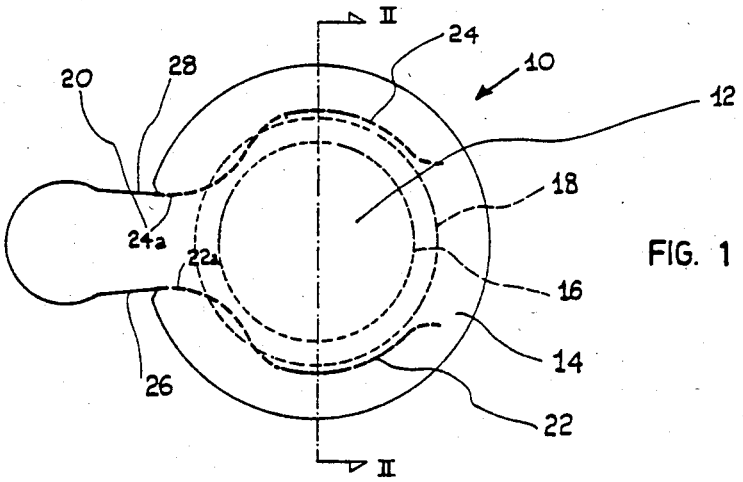
FIG. 1 is a top plan view of a blank of a bottle cap according to the present invention.

With reference to the accompanying drawing, and particularly to the FIG. 1 thereof, it is seen that the present cap is carried out starting from a blank 10, made from a metallic material, preferably from aluminium. The blank 10 comprises an innermost central portion 12, designed to form the central top wall of the cap. The central portion 12 is surrounded by an outermost peripheral portion 14, designed to form the lateral band or skirt which extends, in the use of the cap, on the lateral outermost part of the mouth of the bottle.

By means of broken lines 16, 18 there is just shown the position that the uppermost surface of the mouth of the bottle will take on when the cap will be put at work, a bending of the blank 10 being carried out approximately along the outermost line 18 of the mouth at a working stage subsequent to that shown in FIG. 1.

A tear-off tab 20 extends radially with respect to the peripheral band 14 and is separated from it by two score lines 22 and 24, which start at the lateral edges 26 and 28 of the tab 20 and go on parallel to the mouth of the bottle and approximately at its maximum diameter, shown by the broken line 18, i.e. of the boundary line between the top wall 12 and the lateral band 14.

Figure 2:
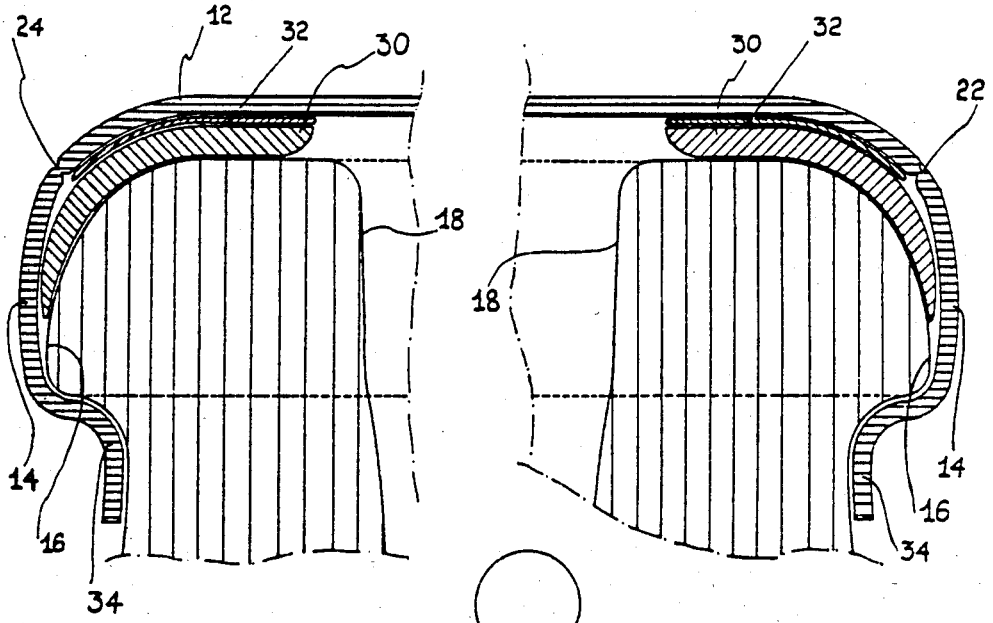
FIG. 2 is a cross-section view of a cap made out from the blank of FIG. 1 and applied on the mouth of a bottle.

With reference now to FIG. 2, it is seen that, after the complete formming of the cap, an angular sealing gasket 30 is arranged inside the cap and is bonded or anyway made to stick at a bond area 32 to the undersurface of the central top wall 12, inside the two score lines 22 and 24.

When the cap is applied on the bottle, the gripping of the lateral band 14 at its lowermost part 34 causes the cap, the sealing gasket and the mouth of the bottle to forcedly come together, assuring the perfect pressure tightness even in the presence of little irregularities and thus the perfect preservation of the pressure existing in the bottle at the moment of the bottle filling.

By means of any one of the well known techniques of bonding reserved to localized areas, the bonding between the angular sealing and the cap is limited to the already cited bond area 32, which extends for 360 degrees on the undersurface of the central top wall, as well as inside the area of the lateral band bounded by the segments *22a* and *24a* of the score lines 22 and 24, respectively.

Of course, the bond area can be limited to one or more parts of the entire 360 degree ring, and bonding between the sealing and the cap can be omitted at the tear tab area.

On the contrary, the angular sealing 30 is in the most accurate way kept free from bonding to the lateral band 14 of the cap; in other words, the angular sealing gasket 30 is completely free to move and slide with respect to all the area which is outside the almost circular path of the score lines 22 and 24.

Figure 3:
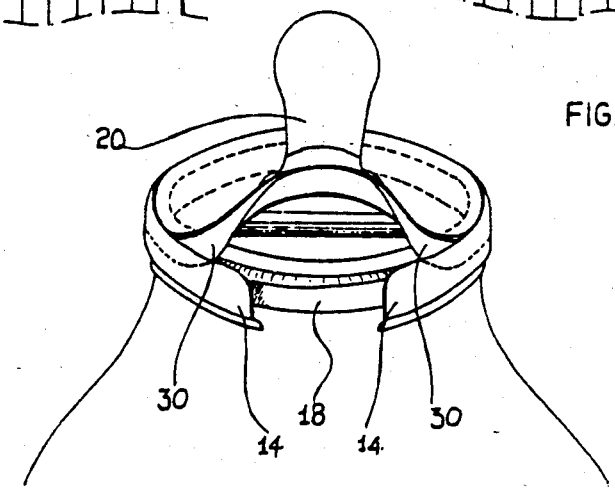
FIG. 3 is a perspective view and shows the present cap in a partial opening stage.

Upon opening the bottle by means of the tear of the cap according to the present invention, the angular sealing gasket 30 is not broken in any point, but, as shown in FIG. 3, it is lifted in one piece from the mouth of the bottle, so that in this way the strain of tearing the sealing gasket, concentrated in the initial tear-off stage, is avoided, with consequent increased ease of use by the consumer.

Furthermore, it is to point out again that, proceeding further on to the tear of the cap, the sealing or gasket ring 30, which lifts along with the central top wall to which it is bonded, acts as a kind of tin-opener, weakening the grip of the two portions of the lateral band 14 and ousting them from the mouth of the glass.

In such a way, the coming off action of the cap from the bottle is carried out with a minimum of strain and without stumbling and jerking.

As already stated, the sugar residues of bottled drinks tend to bond the sealing gasket against the mouth of the bottle, making it even more difficult the operation of removal of the cap from the bottle.

However, while with prior art caps the action of removal from the mouth of the bottle required a noticeable manual strain to move away the generally C shaped lateral bands still gripping the opening of the bottle in order to overcome the maximum diameter of the mouth, the cap according to the present invention allows overcoming of the maximum diameter by creating a play between the lateral bands 14 and the mouth by means of the progressive slipping off of the sealing gasket 30. This play allows the maximum diameter of the mouth to be overcome without having to make any strain to obtain the mechanical spreading of the bands still gripping the mouth.

Obviously, the score lines can be carried out in various ways, for instance on the innermost or the outermost surface of the cap, naturally respecting the principle of bonding the sealing to the central top wall and using the lifting of the sealing gasket, which, intact, is pulled upwards along with the central top wall, to create an empty gap between the edge of the mouth of the bottle and the lateral band of the cap, due to the slipping-off of the sealing.

Just this gap, which is set empty by the sealing gasket while it is being lifted, renders the lateral band easily disengageable from the edge of the neck of the bottle, making a soft and snatch-free opening of the bottle possible.

Although in the present description reference has always been made to wide mouth glass bottles, it is clear that the caps according to the present invention can be used for the closure of any type of container having a mouth to be closed, independently from the material, of which the container is made and from the kind of matter packed inside it.

It is obvious that other numerous and different changes and modifications can be performed by those skilled in the art on the above described embodiment of the present invention, without departing from its scope. It is intended therefore that all these changes and modifications are encompassed in the field of the invention.

We claim:

1. A bottle cap, of the tear-off type in which a central top wall which covers the top portion of the mouth of the bottle is connected to a lateral band which surrounds the opening of the neck of the bottle and is bent under the edge of the neck to grip the cap, and a tear-off tab, bounded by score lines extending from the top wall through the lateral band, and an angular sealing gasket interposed between the mouth of the bottle and the top wall and between the lateral band and the bottle mouth, said cap characterized in that said angular sealing gasket is bonded to the undersurface of the central top wall at a bond area inside the score lines, whereby, when the cap is broken by lifting the central top wall by means of the tear tab, the angular sealing gasket is lifted with the central top wall in one piece and slips off from underneath the lateral band thereby freeing or loosening the lateral band from the mouth of the bottle.

2. A bottle cap as in claim 1, characterized in that said angular sealing gasket is also bonded to the tear tab at the area bounded by the score lines, to make the lifting of the sealing gasket itself along with the central top wall easier, without breaking said sealing gasket.

3. A bottle cap as in claim 1, characterized in that said score lines are located, at least for a part of their path, at the boundary edge between the central top wall and the lateral band.

4. A bottle cap as in claim 3, characterized in that said score lines, starting from the tear tab, first cross at right angles the lateral band and then are gradually connected to the part located at the boundary edge between the central top wall and the lateral band.

5. A bottle cap as in claim 1, characterized in that said score lines extend at least partially into said lateral band.

* * * * *